US005896702A

United States Patent [19]

Wæhrens et al.

[11] Patent Number: 5,896,702

[45] Date of Patent: Apr. 27, 1999

[54] OPERATOR WITH AT LEAST TWO LINKAGE MECHANISMS FOR OPENING AND CLOSING PIVOTAL WINDOWS

[75] Inventors: Jens Jakob Wæhrens, Vordingborg; Peter Søger, Roskilde; Henrik Vollmond, Søborg, all of Denmark

[73] Assignee: V. Kann Rasmussen Industri A/S, Søborg, Denmark

[21] Appl. No.: 08/756,327

[22] Filed: Nov. 26, 1996

[30] Foreign Application Priority Data

Dec. 1, 1995 [DK] Denmark ..... 1359/95

[51] Int. Cl.[6] ..... E05F 11/00

[52] U.S. Cl. ..... 49/325; 49/331

[58] Field of Search ..... 49/324, 325, 326, 49/327, 331, 334, 338, 333, 335, 336, 337, 246

[56] References Cited

U.S. PATENT DOCUMENTS

| | | | |
|---|---|---|---|
| 1,333,595 | 3/1920 | Anderson . | |
| 2,017,543 | 10/1935 | Madsen | 49/325 |
| 4,014,136 | 3/1977 | Hemens et al. | 49/325 |
| 4,235,117 | 11/1980 | Pickles . | |
| 4,521,993 | 6/1985 | Tacheny et al. . | |
| 4,819,495 | 4/1989 | Hormann . | |
| 4,827,668 | 5/1989 | Bechtold | 49/325 |
| 4,933,613 | 6/1990 | Berner et al. . | |
| 4,945,678 | 8/1990 | Berner et al. | 49/325 |
| 5,004,961 | 4/1991 | Berner et al. . | |
| 5,156,574 | 10/1992 | Gai . | |
| 5,271,182 | 12/1993 | Greisner et al. . | |
| 5,406,750 | 4/1995 | Lindgren | 49/325 |

*Primary Examiner*—Daniel P. Stodola
*Assistant Examiner*—Curtis Cohen
*Attorney, Agent, or Firm*—Lane, Aitken & McCann

[57] ABSTRACT

An operator for opening and closing pivotal windows comprises at least two pull and pressure transferring, flexible linkage mechanisms (3,4) connected at one end to a fixture (5,6) on a frame member and at the opposite end in engagement with a driving device (12–17) mounted on the opposite main frame member (2). The driving device is common to the linkage mechanisms and is together with the parts of the linkage mechanisms engaging it mounted in a common housing (7) for receiving the entire length of the linkage mechanisms (3,4) and provided with guides (8,9) and lead-in openings (8*a*,9*a*) for the linkage mechanisms (3,4). A carrier element (10,11) in connection with the guides is via transmission elements (12–16) in the housing 87,28; 54) connected with a common driving unit (17).

16 Claims, 6 Drawing Sheets

Figure 1:
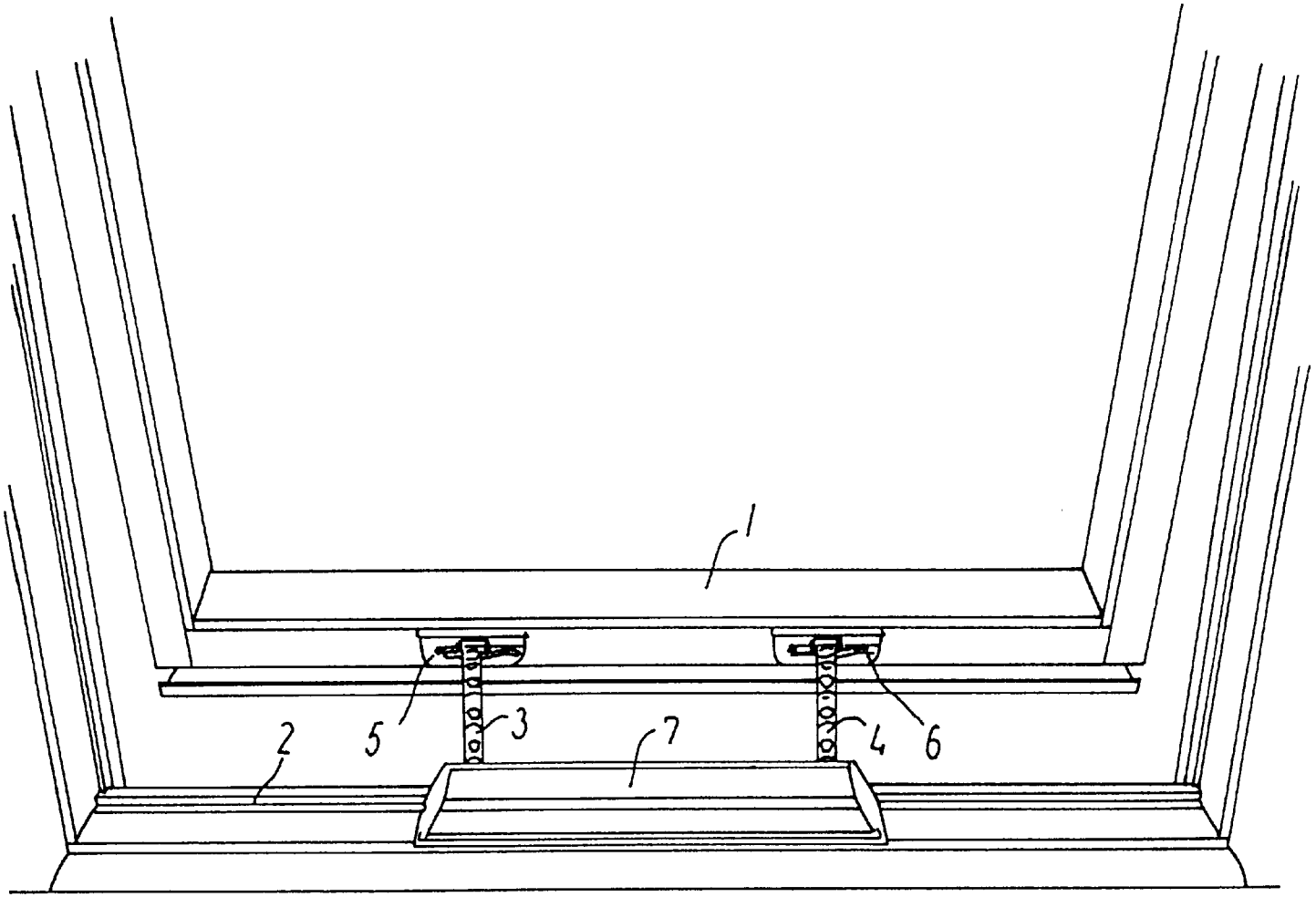

OPERATOR WITH AT LEAST TWO LINKAGE MECHANISMS FOR OPENING AND CLOSING PIVOTAL WINDOWS

The present invention relates to an operator for opening and closing pivotal windows between a closed position and a ventilation position and of the type comprising at least two pull and pressure transferring, flexible linkage mechanisms, which each at one end is connected with a fixture mounted on a frame or main frame member which is in parallel with the pivotal axis of the window and which at the opposite end comprises a part which is in engagement with a driving device mounted on the opposite main frame or frame member, said driving device being common to the linkage mechanisms, which are arranged mutually spaced in the longitudinal direction of said main frame or frame member.

Window operators of this type typically comprise chain operators with a single operator chain, like for instance known from DK patent application No. 4104/89 and U.S. Pat. No. 4,532,993.

From U.S. Pat. No. 1,333,595 it is for simultaneous opening and closing of several windows positioned side by side known to provide a chain operator of the type in question with a corresponding number of operator chains which each at one end is fastened to a common operation rod which is movable forwards and backwards with a channel-shaped cross-section which constitutes a guide groove for the chain lengths running at any time along the rod. The operation rod may be manually operated or motor driven, and its movement is controlled by comparatively space demanding guide rollers journalled in wall-mounted brackets below the windows to be operated by means of the operator mechanism.

This known arrangement is as to its mechanical construction comparatively complicated, which makes installation troublesome, and on account of the wall brackets extending below the windows in question, it is less appealing from an aesthetic point of view.

In view of this prior art the object of the invention is to provide an operator of the type in question for use in connection with bigger single windows of considerable weight or for preventing influence from wind on windows having a big pane area and for operating windows positioned side by side, said operator having a simple, compact construction with a design acceptable from an aesthetic point of view and being easy to mount, also when installed on existing windows.

To meet this object an operator of the type in question is according to the invention characteristic in that the driving device and the parts of the linkage mechanisms in engagement therewith are mounted in a common, substantially closed housing for accommodating the total length of the linkage mechanisms and provided with guide means, and, in a common side wall of the housing, lead-in openings for the linkage mechanisms, a carrier member positioned in connection with said guide means via transmission elements in the housing being connected with a common driving unit.

The linkage mechanisms of the operator according to the invention will typically be chains, for instance of the same type as described in the above U.S. Pat. No. 1,333,595, but may also be other kinds of flexible linkage mechanisms, for instance profiled steel spring belts of the type described in DE published specification No. 4407276.

By mounting both the driving device and the parts of the linkage mechanisms in engagement therewith in a common housing, which is substantially closed, i.e. which is substantially only in a common side wall provided with openings for the linkage mechanisms at the mouth of the grooves, in which they are received, a design which is appealing from an aesthetic point of view is obtained together with a substantially reduced risk of soiling the mechanism.

Accommodation of the linkage mechanisms in grooves provided for that purpose in the housing and without the linkage mechanisms being anchored therein entails a precise guiding of the linkage mechanisms contrary to the embodiment known from U.S. Pat. No. 1,333,595, which embodiment requires a very high degree of precision when placing the chain fastenings along the common operation rod.

Advantageous embodiments of the invention and further developed embodiments thereof appear from the dependent claims.

Figures 2, 3:
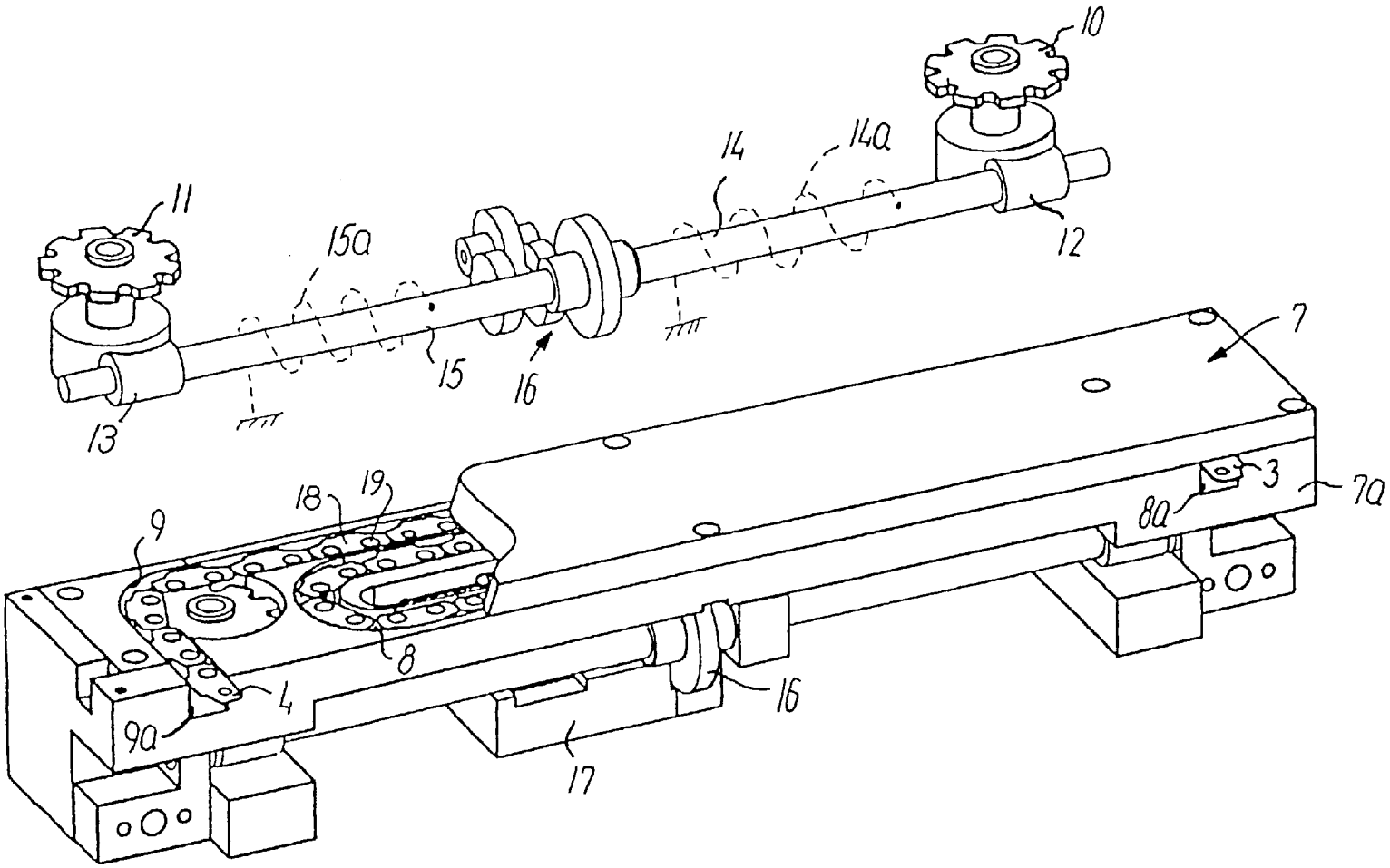
Figure 4:
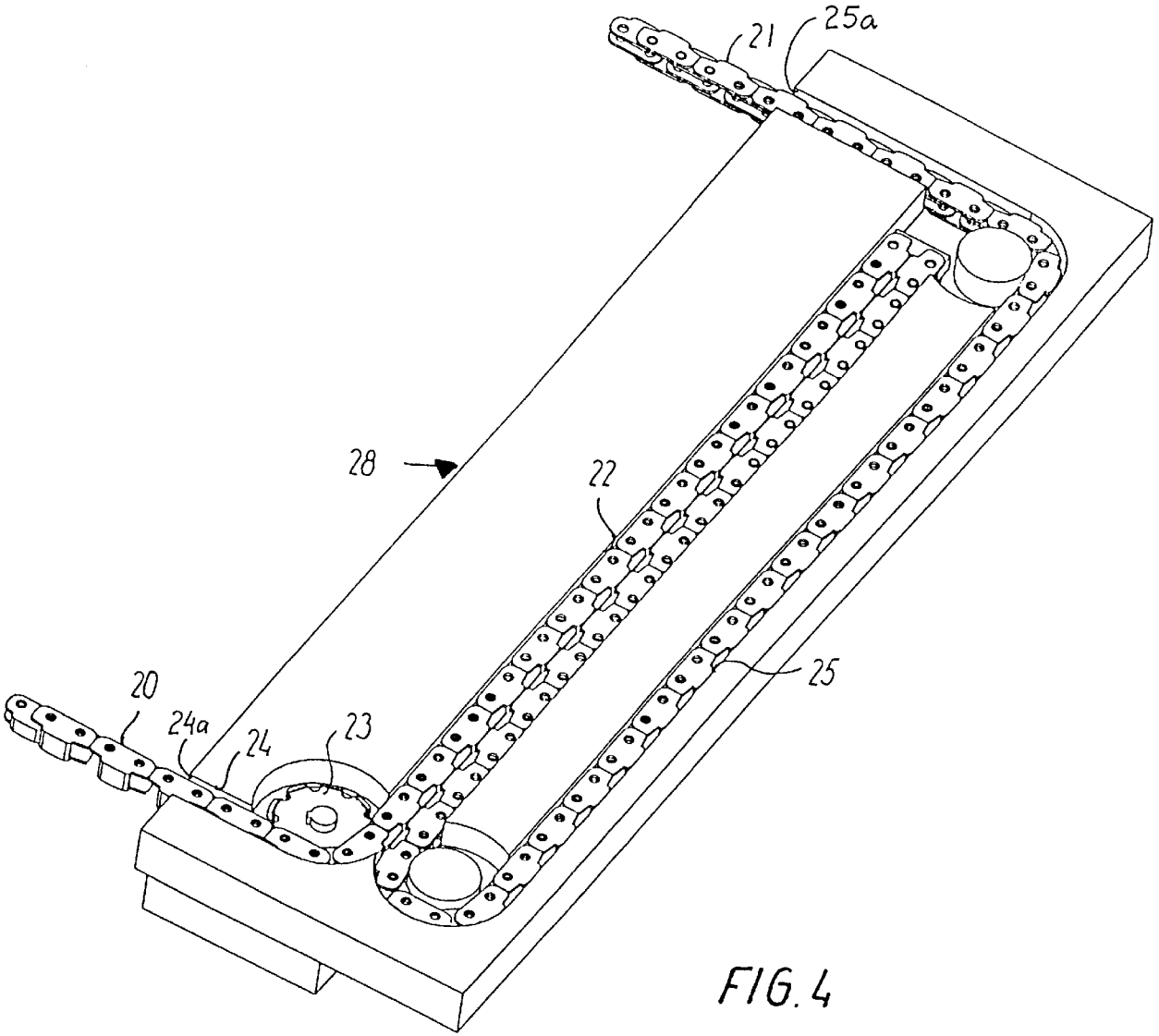
Figure 5:
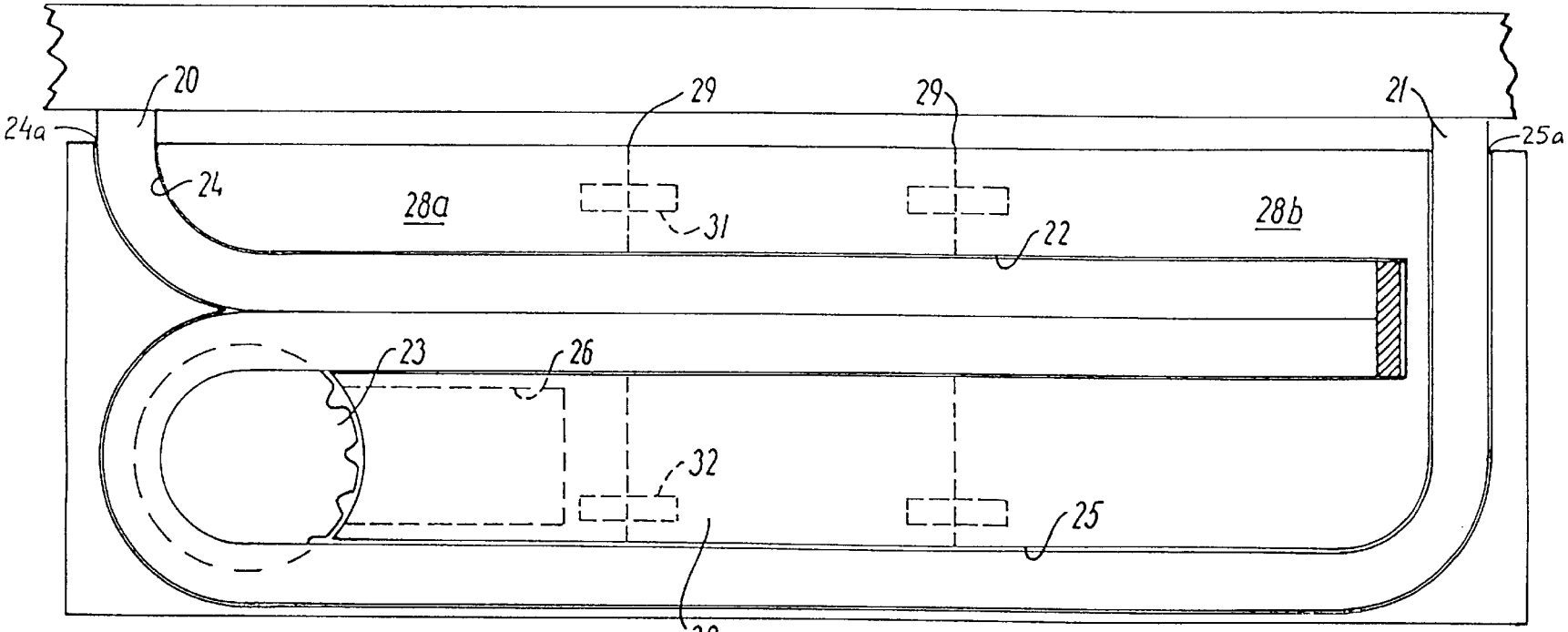
Figure 6:
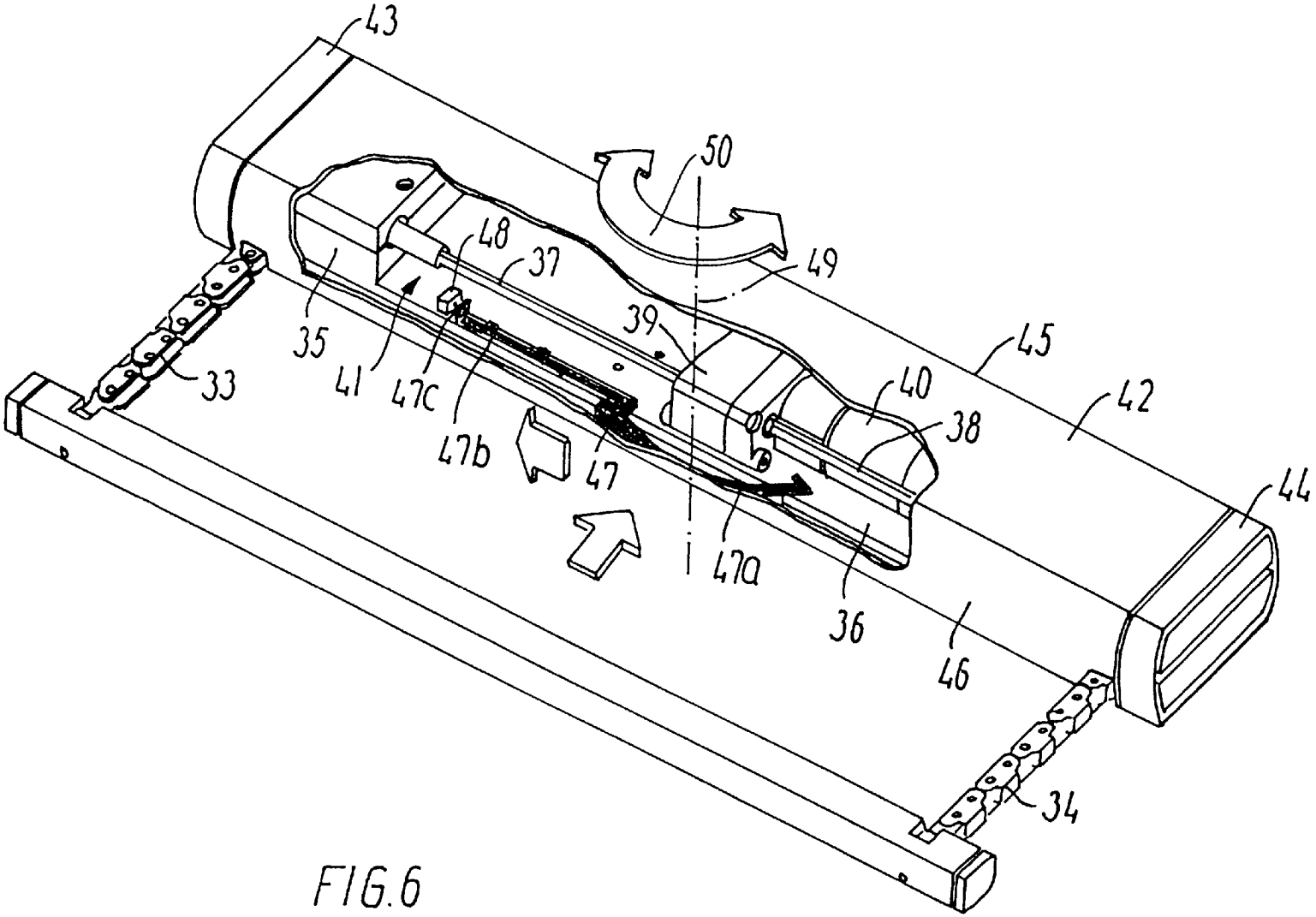
Figure 7:
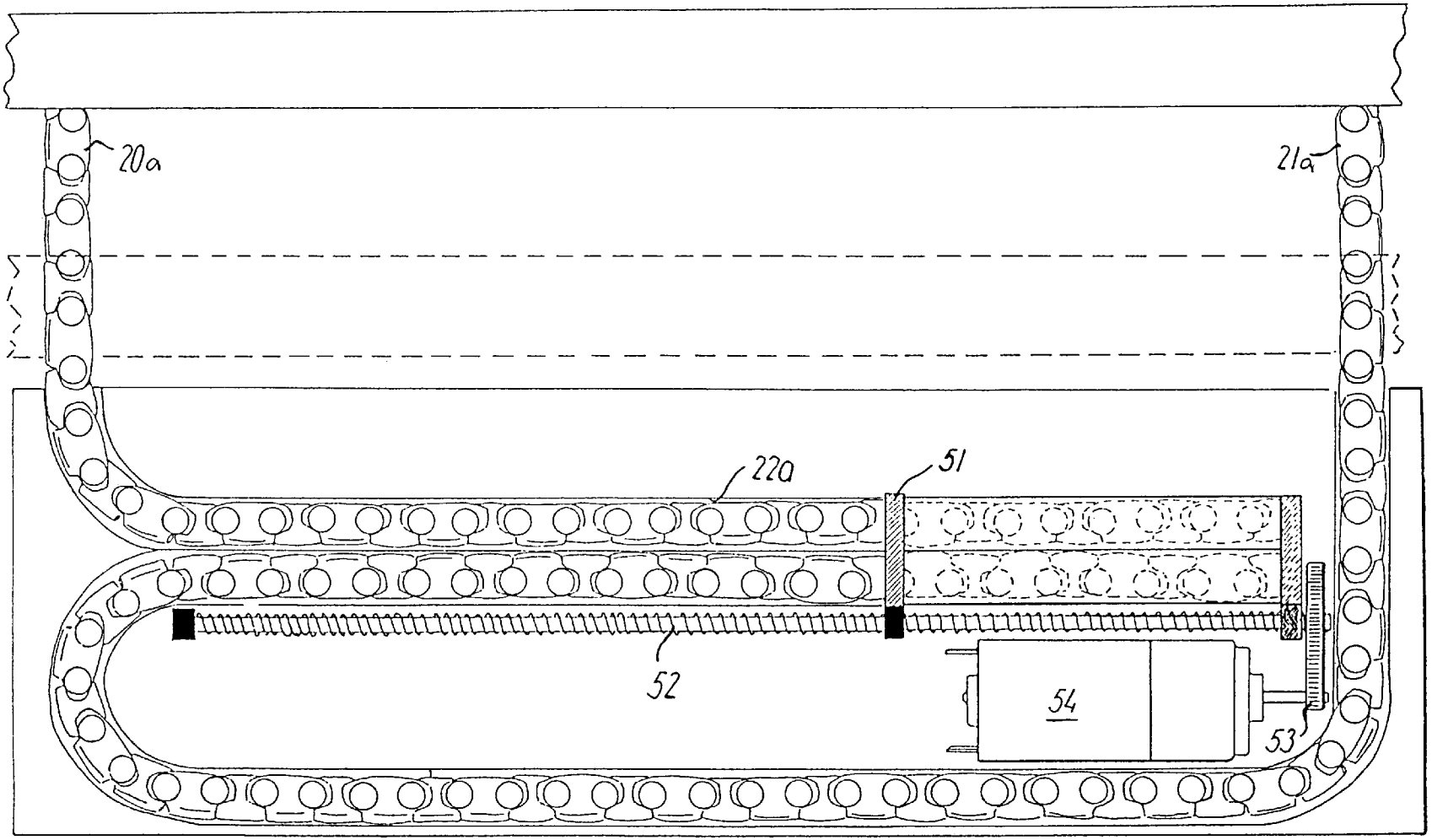

The invention will be described in detail in the following with reference to the schematic drawing, in which FIG. 1 shows a part of a top-hung window provided with an embodiment of a chain operator according to the invention, FIG. 2 shows the operator housing with chain grooves and driving device according to the embodiment of FIG. 1, FIG. 3 shows the mechanic transmission between a driving device and the operator chains according to the embodiment of FIGS. 1 and 2, FIG. 4 shows the chain groove according to another embodiment of the operator housing, FIG. 5 shows a further developed embodiment of the embodiment shown in FIG. 4, FIG. 6 shows a further embodiment designed to prevent a skew pull when closing a window, and FIG. 7 is a modification of the embodiments shown in FIGS. 4 and 5.

In FIG. 1, and in respect of a top-hung window, an embodiment of a double chain operator according to the invention is shown, said chain operator being mounted between a bottom frame member 1 and a bottom main frame member 2, the free ends of the two operator chains 3 and 4 being fastened, possibly detachably, to the frame bottom member 1 by means of mounting fixtures 5, 6, whereas the chains as such are received in a common housing 7 which is mounted on the bottom main frame member 2.

As shown in FIGS. 2 and 3, the housing 7 is provided with guide means in form of stationary grooves 8 and 9 for receiving the parts of the operator chains 3 and 4 positioned in the housing. In connection with each of the grooves 8 and 9 a carrier element is provided, in the embodiment shown sprocket wheels 10 and 11, which each via a worm transmission 12, 13 and a drive shaft half 14, 15 is connected with a gear transmission 16, which is connected to an electric drive motor 17. The grooves 8 and 9 lead to lead-in openings 8*a* and 9*a* in a side wall 7*a* of the housing 7.

The operator chains 3 and 4 are in a conventional way composed by chain links 18 which are connected by means of rivets or pins 19. In the embodiment shown the chains 3 and 4 are, as is known per se from U.S. Pat. No. 1,333,595, designed such that they are substantially only flexible in a plane perpendicular to the axis of rotation of the chain joints, i.e. in parallel with the frame members and the main frame members 1, 2, but they show considerable rigidity against bending forces perpendicular to this plane.

Contrary to the operator chains in conventional chains operators of the type disclosed in U.S. Pat. No. 4,521,993, the active parts of the operator chains 3 and 4 will, as shown in FIG. 1, thus take up a pronounced rectilinear course. For adapting the mounting of the operator housing 7 thereto, the housing 7 is preferably connected in such a way to the bottom main frame member 2 that relative thereto it is pivotal around an axis parallel with the longitudinal direction of the housing, such that it may follow the linkage movement of the operator chains 3 and 4.

According to the embodiments of FIGS. 1–3 the grooves 8 and 9 are separate for each of the operator chains 3 and 4, and the carrier elements 10, 11 in form of sprocket wheels are placed in connection with each of the grooves 8 and 9.

Particularly for use in connection with a sloping roof window the biggest energy requirement will occur during the opening movement, where the weight of the window frame is to be overcome solely by the pressure from the chains 3 and 4.

To reduce this energy requirement the operator may be designed such that, with a view to producing an auxiliary force for the opening movement of the window, an energy storing takes place during the closing movement, where the closing force is produced by the weight of the window, until the pressure therefrom is surmounted by sealing pressure from the sealing positioned between the frame and the main frame.

Such an energy storing may be produced by tightening a suitable spring load, in the embodiment shown for instance in form of torsion springs 14*a* and 15*a* surrounding the shaft half 14 and 15 and being connected to a shaft half and the housing 7 or to roller springs arranged around the shafts of the sprocket wheels 10 and 11, respectively.

According to another embodiment shown in FIG. 4 the two operator chains 20 and 21 may on a part of their length, counted from the end opposite the mounting fixtures, be mutually connected and led in a common groove 22, such that the two chains 20 and 21 may be driven by means of a single carrier element in form of a sprocket wheel 23. In extension of the common groove 22, the operator chains 20 and 21 are led in each their separate groove 24 and 25, respectively, to lead-in openings 24*a* and 25*a*.

By this embodiment the driving mechanism as shown in FIG. 5 may be simplified, the sprocket wheel 23 being directly connectable with the drive motor 26 with accompanying gear transmission.

By this embodiment the driving device may also as shown in FIG. 7 be designed in another way, for instance by comprising a nut member 51 connected with the coupled lengths of the operator chains 20*a* and 21*a* in connection with a screw spindle 52 extending in parallel with the common groove 22*a* and being via a transmission 53 connected with the drive motor 54.

Also in accordance with the embodiments in FIGS. 4, 5, and 7 the operator may be designed for energy storing during the closing movement as described above, for instance by mounting, along the common groove 22, for instance below it, a tension spring, one end of which is fastened to the ends of the coupled parts of the chains 20 and 21 and the other end being fastened in the housing, for instance at the transition between the common groove 22 and the separate grooves 24 and 25.

By designing the embodiment shown in such a way that the common groove is rectilinear substantially through its entire length, and such that the separate groove 25 for one of the operator chains 21 likewise is rectilinear and in parallel with said common groove 22, it becomes possible, by designing the housing 28 in two parts with connectable housing parts 28*a* and 28*b* with a common dividing plane 29 perpendicular to the longitudinal direction of the grooves, advantageously to vary the total length of the operator housing 28 by coupling between the two housing parts 28*a* and 28*b*, as shown in FIG. 5, a separate insertion piece 30 which may be of variable length, simultaneously with a corresponding increase of the length of the chains 20 and 21.

In view of a mutually secured positioning, the housing parts 28*a* and 28*b* may be provided with engagement means in form of guide pins 31, 32 or the like.

In the embodiment according to FIG. 6 the operator chains 33 and 34 are received in compartments 35 which are mutually connected through a rail 36 and each holds not shown guide means and carrier elements in form of sprocket wheels and via the drive shaft halves 37 and 38 are in integral connection with a gear transmission 39 coupled with an electric drive motor 40 in such a way that these parts constitute a complete operator unit 41.

This integrated operator unit 41 is floatingly mounted in a housing 42 with a predetermined clear, preferably 3–4 mm relative to the inside faces of its walls.

In this embodiment the operator unit 41 with the full length of the chains 33 and 34 received in the compartments 35 may be introduced into the housing 42 from one end after the fastening of the housing on a frame or main frame member, the end walls 43 and 44 of the housing being detachable.

In addition to simplifying the mounting work the floating mounting of the operator unit 41 in the housing 2 makes it possible to compensate for irregularities, if any, at the mounting of the housing 42 and to advantageously reduce the risk of skew pulling the window.

Such a risk of skew pulling may, in embodiments where the driving device and the guide means and carrier elements for the chains are stationary relative to the housing, arise due to the fact that the frame and main frame construction of the window work, for instance as a consequence of varying moist absorption. Thereby skewness may result between frame and main frame, following which the two operator chains at the closing of the window pull the frame askew towards the main frame, which may partly result in leaks between the frame and the main frame, and partly result, in part of the construction, in an overloading of a sealing positioned between the frame and the main frame.

By use of the embodiment according to FIG. 6 in connection with an inclined roof window, the weight of the window frame will in its open position cause the operator unit 41 into abutment against the side wall 45 (facing away from the window frame) of the housing 42. When closing the window it will alone be the weight of the frame which brings the frame towards the main frame. The operator unit 41 acts in this phase in practice solely as collector of the chains 33 and 34.

Not until the frame has been brought into abutment against the sealing mounted on the main frame construction and the pressure therefrom exceeds the weight of the frame, will the chains 33 and 34 act as pulling elements, and the operator unit 41 tightens the frame towards the main frame, until the desired sealing pressure has been established, the operator unit 41 moving on account of the floating mounting into abutment against the inner surface of the side wall 46 facing the frame of the housing 42.

In order to control this displacement of the operator unit and to simultaneously ensure that the motor current to the drive motor 40 is disconnected, as soon as the desired sealing pressure has been established, a springy element in connection with the operator unit 41 may be mounted between the operator unit 41 and the side wall 46, for instance as shown a compound spring 47, which is designed for abutment against the side wall 46 and comprises an activating part for a switch for the motor current.

The compound spring 47 may, as shown, at one end part be provided with a curved portion 47*a* for abutment against the side wall 46 and at its free end be fastened to the connection rail 36 of the operator unit 41. The second end portion of the compound spring 47 is designed as a substantially rectilinear portion 47*b*, which by compressive stress of the curved portion 47*a* is displaced in the longitudinal direction of the rail 36, whereby its free end 47*c* may actuate a micro switch 48 mounted on the rail 36 and serving as a switch for the motor current.

During closing of the window the curved portion 47*a* of the compound spring 47, which is in abutment against the housing wall 46, will be exposed to compressive stress and become deformed, when the operator unit 41, when the sealing pressure has started to exceed the pressure from the weight of the frame, moves in a direction towards the wall 46. The operator unit 41 will then turn around a rotational axis 49 determined by the point of contact between the curved portion 47*a* of the compound spring and the wall 46 as indicated by the double arrow 50, whereby any skewness will be equalized.

The compound spring 47 is dimensioned with such a length and spring characteristic that the micro switch 48 will not be activated until the skewness, if any, has been equalized and the desired sealing pressure established.

Another possibility is to mount the micro switch 48 in such a way on the operator unit 41 that its contact element in itself forms a point of contact between the operator unit 41 and the housing wall 46, the switch having to be subjected to a spring bias which may resist the forces during the equalization of skewness, if any, but still disconnecting the motor current when the desired sealing pressure has been established in the whole sealing between frame and main frame.

We claim:

1. The combination of a window having a main frame and at least one sash arranged pivotally with respect to said main frame and an operator for opening and closing said at least one sash between a closed position and a ventilation position with respect to said main frame, said operator comprising at least two pull and pressure transferring, flexible linkage mechanisms (3,4; 20,21; 20*a*,21*a*; 33,34) each of which is connected at one end with a respective fixture (5,6) mounted on a first member forming part of one of said at least one sash and said main frame and extending parallel to a pivotal axis of the window, said flexible linkage mechanisms each having a part driven by a common driving device (12–17; 37–40; 52–54) mounted on a second member forming part of the other of said at least one sash and said main frame and extending in opposed and parallel relationship to said first member, said fixtures being arranged with mutual physical separation in the longitudinal direction of said first member (1,2) such that the fixtures are spaced apart from one another, characterized in that the driving device (12–17; 26; 37–40; 52–54) is mounted together with said parts of the linkage mechanisms (3,4; 20,21; 20*a*,21*a*; 33,34) in a common, substantially closed housing (7; 28; 42) in which guide means (8,9; 22,22*a*,24,25) are provided for accommodating the total length of each of said linkage mechanisms (3,4; 20,21; 20*a*,21*a*; 33,34), openings (8*a*,9*a*; 24*a*,25*a*) for the linkage mechanisms (3,4; 20,21; 20*a*,21*a*) being provided in a common side wall (7*a*; 46) of the housing with a physical separation corresponding to said mutual physical separation of said fixtures, and carrier means (10,11; 23; 51) provided in the housing (7,28; 42) in connection with said guide means for connecting said part of each linkage mechanism with said common driving device (17,26,40,54).

2. The combination according to claim 1 characterized in that the linkage mechanisms (3,4; 20,21; 33,34) are flexible solely in a plane parallel with said first and second members (1,2) but are considerably rigid against bending forces perpendicularly to this plane, and that the housing (7,28,42) is connected with said second member (2) such that it is pivotable around an axis parallel with the longitudinal axis thereof.

3. The combination according to claim 1, characterized in that said guide means comprises grooves (8,9) leading to said openings (8*a*,9*a*) and separately accommodating the two linkage mechanisms (3,4), said carrier means comprising carrier elements (10,11) positioned in connection with each of said grooves (8,9) for engaging each respective linkage mechanism (3,4) and connected with the common driving unit via separate transmission elements (12,14; 13,15).

4. The combination according to claim 3 characterized in that said carrier element (10,11; 23) comprises at least one sprocket wheel in engagement with at least one of said operator chains (3,4; 20,21).

5. The combination according to claim 1, characterized in that on a part of their length counted form the end opposite the mounting fixtures the two linkage mechanisms (20,21; 20*a*,21*a*) are mutually coupled and guided in a common groove (22,22*a*), in connection with which a single carrier element (23, 51) acting on the coupled lengths of the linkage mechanisms (20,21; 20*a*,21*a*) is positioned.

6. The combination according to claim 5, characterized in that said carrier element (23) is a drive wheel in engagement with one of the coupled linkage mechanisms (20,21) and connected with said transmission elements.

7. The combination according to claim 5, characterized in that said carrier element (51) is a nut member connected with the coupled lengths of the linkage mechanisms (20*a*, 21*a*) in connection with a screw spindle (52) extending in parallel with a rectilinear part of said common groove (22*a*).

8. The combination according to claim 5, characterized in that the entire length of the common groove (22,22*a*) is rectilinear, and that in parallel with said common groove (22,22*a*) in the housing (28) a likewise rectilinear section of a separate groove (25) for one of the linkage mechanisms (21) is provided, the housing (28) being designed in two parts by to a dividing plane (29) perpendicular to the longitudinal direction of said groove (22,25).

9. The combination according to claim 8, characterized in that the two parts (28*a*,28*b*) of the housing (28) at said dividing plane (29) are provided with engagement means (31,32) for securing the mutual positioning of the two parts of the housing (28*a*,28*b*) in extension of each other.

10. The combination according to claim 9, characterized in comprising an insertion piece (30) to be positioned between the two house parts for increasing the entire length of the housing.

11. The combination according to claim 1, characterized in that the driving device (40) together with said transmission elements (37–39) is designed as an operator unit (41) in integral connection with carrier elements in compartments (35) for receiving the linkage mechanisms, said operator unit (41) being floatingly mounted in the housing (42) with a predetermined clear relative to the inside faces of its walls.

12. The combination according to claim characterized in that a switch (48) for the motor current is connected with said operator unit (41) such that it switches off when, by displacement of the operator unit (41) in the housing in the direction towards said common side wall (46), a desired sealing pressure has been established, the switch (48) being affected by a springy member which allows equalization of misalignments, if any, before said switching off.

13. The combination according to claim 12 characterized in that said springy member is constituted by a compound spring (47) which in an end part is provided with a curved portion (47*a*) for abutment against said shared side wall (46), the free end of said part being fastened to the operator unit (41), and the other end part being provided with a substantially rectilinear portion (47*b*), which is longitudinally displaceable by compressive stress on the curved portion (47*a*), and the free end of which form an actuator for said switch (48).

14. The combination according to claim 1 characterized in that the linkage mechanisms (3,4; 20,21; 20*a*,21*a*; 33,34) are chains.

15. The combination according to claim 1, in particular for use in connection with an inclined roof window, characterized in that an energy-collecting spring member (14*a*, 15*a*) is mounted between the linkage mechanisms or a transmission element (14,15) and the common housing (7) to collect energy during the closing movement and produce an auxiliary force for the opening movement of the window.

16. The combination according to claim 1, wherein each of the linkage mechanisms defines a length between its respective fixture and its respective common side wall opening, the linkage mechanisms having mutual physical separation throughout said lengths when the window is in an open position.

* * * * *

UNITED STATES PATENT AND TRADEMARK OFFICE

CERTIFICATE OF CORRECTION

PATENT NO. : 5,896,702

DATED : April 27, 1999

INVENTOR(S) : Jens Jakob Waehrens et al.

It is certified that error appears in the above-indentified patent and that said Letters Patent is hereby corrected as shown below:

Title Page, Item [75], line 2, "Roskilde" should read --Havdrup--.

Signed and Sealed this

Eleventh Day of April, 2000

*Attest:*

*Attesting Officer*

Q. TODD DICKINSON

*Director of Patents and Trademarks*